US005732671A

United States Patent [19]

Takami et al.

[11] Patent Number: 5,732,671

[45] Date of Patent: Mar. 31, 1998

[54] METHOD AND APPARATUS FOR MANUFACTURING CYLINDER BLOCKS

[75] Inventors: Toshihiro Takami, Toyota; Mitsuhiro Karaki, Okazaki, both of Japan

[73] Assignee: Toyota Jidosha Kabushiki Kaisha, Toyota, Japan

[21] Appl. No.: 753,653

[22] Filed: Nov. 27, 1996

[30] Foreign Application Priority Data

Nov. 29, 1995 [JP] Japan ..... 7-311099

[51] Int. Cl.[6] ..... F02F 1/00

[52] U.S. Cl. ..... 123/193.2

[58] Field of Search ..... 123/193.2, 193.3, 123/41.74, 195 R, 41.84; 29/888.061

[56] References Cited

U.S. PATENT DOCUMENTS

| | | | |
|---|---|---|---|
| 4,469,060 | 9/1984 | Jordan . | |
| 4,903,652 | 2/1990 | Field et al. | 123/193.2 |
| 5,291,862 | 3/1994 | Katoh et al. | 123/193.2 |
| 5,357,921 | 10/1994 | Katoh et al. | 123/193.2 |
| 5,537,969 | 7/1996 | Hata et al. | 123/193.2 |

FOREIGN PATENT DOCUMENTS

| | | |
|---|---|---|
| 0356227 | 2/1990 | European Pat. Off. . |
| A-0744541 | 11/1996 | European Pat. Off. . |
| A-2572968 | 5/1986 | France . |
| 5-321751 | 12/1993 | Japan . |
| WO-A-9215415 | 9/1992 | WIPO . |

OTHER PUBLICATIONS

Popular Science Anee 1985 Manque, vol. 242, No. 3, Mar. 1, 1993, p. 46 XP000345512 "honda's metal matrix".

*Primary Examiner*—Marguerite McMahon
*Attorney, Agent, or Firm*—Kenyon & Kenyon

[57] ABSTRACT

A method of manufacturing cylinder blocks. A cylinder block includes cylinder liners, the number of which corresponds to the number of cylinders in the engine, and a block body molded integrally with and about the cylinder liners. A liner assembly is formed by aligning cylinders in a single row and connecting the adjacent cylinder liners. A variable section provided between each pair of cylinders enables the distance between the axes of the outer cylindrical surface of each cylinder liner to be varied. The block body is molded by first arranging the liner assembly in a mold. Molten metal is then charged into the mold. When the metal solidifies, the block body is formed encompassing the liner assembly. A reference point on the block body is used to machine the inner cylindrical surfaces and form the cylinder bores.

23 Claims, 12 Drawing Sheets

METHOD AND APPARATUS FOR MANUFACTURING CYLINDER BLOCKS

BACKGROUND OF THE INVENTION

1. Field of the Invention

The present invention relates to a method and an apparatus for manufacturing engine cylinder blocks, and more particulary, to a method and an apparatus for manufacturing a cylinder block that employs a cylinder liner having a plurality of bores for a multiple cylinder engine and a block body molded about the liner.

2. Description of the Related Art

A cylinder block constitutes a multiple cylinder engine. A first type of cylinder block is entirely made of cast iron. TO manufacture this type of cylinder block, a rough block material is molded with holes that correspond to the engine's cylinders. The walls of each hole are machined about an axis that is separated by a predetermined distance from a certain reference position on the rough block material to define a cylinder bore.

Japanese Unexamined Patent Publication No. 5-321751 describes a second type of cylinder block, which is shown in FIGS. 24 and 25. As shown in the drawings, a cylinder block 93 includes a cylinder liner 91 made of cast iron and an aluminum block body 92, which encompasses the liner 91. The cylinder liner 91 include a plurality of cylinders 96, which have the same wall thickness, and connecting sections 97, which are connected to adjacent cylinders 96. The axis L1 of the inner cylindrical surface 94 of each cylinder 96 coincides with the axis L2 of the outer cylindrical surface 95 of the same cylinder 96. Each cylinder 96 has the same diameter.

The cylinder block 9S of the second type manufactured in the same manner as the cylinder block of the first type. In other words, the cylinder liner 91 is first formed as shown in FIG. 24. After arranging the liner 91 in a mold, molten metal is charged into the mold. The block body 92 is formed about the liner 91 when the metal solidifies as it contracts. This allows the rough block material to be produced with the cylinder liner 91 contained therein. The inner cylindrical surface 94 of each cylinder 96 is machined about an axis which is separated by a predetermined distance from a certain reference position provided on the block body 92. As shown in FIG. 25, this defines the cylinder bores #1 and #2 in the cylinder block However, the molten metal generally contracts about 0.6% after being charged into the mold during the molding process. In comparison, substantially no contraction takes place in the cylinder liner 91. Therefore, when machining the cylinder block 93 of the second type by using a reference point on the block body 92 in the same manner as the first type, each cylinder bore #1, #2 is formed with their axis L3 separated from the axis of the outer cylindrical surface 95 of the associated cylinder 96. This results in each cylinder 96 having a wall which thickness differs between sections. The difference in wall thickness may result in insufficient strength of the cylinder 96 especially at sections where the walls become thin. In FIG. 25, the double-dotted line shows the inner cylindrical surface 94 of each cylinder 96 before machining and the solid line shows the cylindrical surface 94 after machining. The outer cylindrical surface 95 is shown by the dotted line.

SUMMARY OF THE INVENTION

Accordingly, it is a primary objective of the present invention to provide a method and an apparatus for manufacturing a cylinder block, which includes cylinder liners and a block body molded about the liners, that enables the axes of the outer and inner cylindrical surfaces of a cylinder of each cylinder liner to coincide with each other and thus allows the cylinder to have a wall thickness which is uniform.

To achieve the foregoing and other objects and in accordance with the purpose of the present invention, a method for manufacturing a cylinder block for an internal combustion engine is provided. The cylinder block has a liner assembly and a block body molded around the liner assembly. The liner assembly has a plurality of adjacent cylinder liners, wherein each cylinder liner has an outer cylindrical surface, an inner cylindrical surface and a cylinder bore formed in the inner cylindrical surface. Each outer cylindrical surface, inner cylindrical surface and cylinder bore have an independent axis. Each cylinder bore axis is set at a predetermined position in the cylinder block. The method comprises forming the cylinder liners such that the outer cylindrical surface and the inner cylindrical surface of the same cylinder liner are coaxial and such that each liner includes a variable coupling structure on its outer surface, forming the liner assembly by coupling the cylinder liners with each other using the variable coupling structure to align the cylinder liners in a single row, wherein the step of forming the liner assembly includes mating the coupling structure of one liner with that of an adjacent liner to allow variation of the distance between the axes of the outer cylindrical surfaces of adjacent cylinder liners, positioning the liner assembly in a mold such that the axis of the outer cylindrical surface of each liner s offset from the predetermined position of the axis of the cylinder bore associated therewith, molding the block body around the liner assembly by pouring molten metal into a mold and by solidifying the molten metal, wherein the axis of the outer cylindrical surface of each liner relocates to substantially coincide with the predetermined position of the axis of the associated cylinder bore as a consequence of movement of the variable coupling structures as the molten metal cools and is solidified, and forming each cylinder bore at the predetermined positions by machining each inner cylindrical surface, wherein the predetermined position of each cylinder bore axis is a predetermined distance from a predetermined reference position on the block body.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A first embodiment according to the present invention will hereafter be described with reference to FIGS. 1 to 11.

Figure 9:
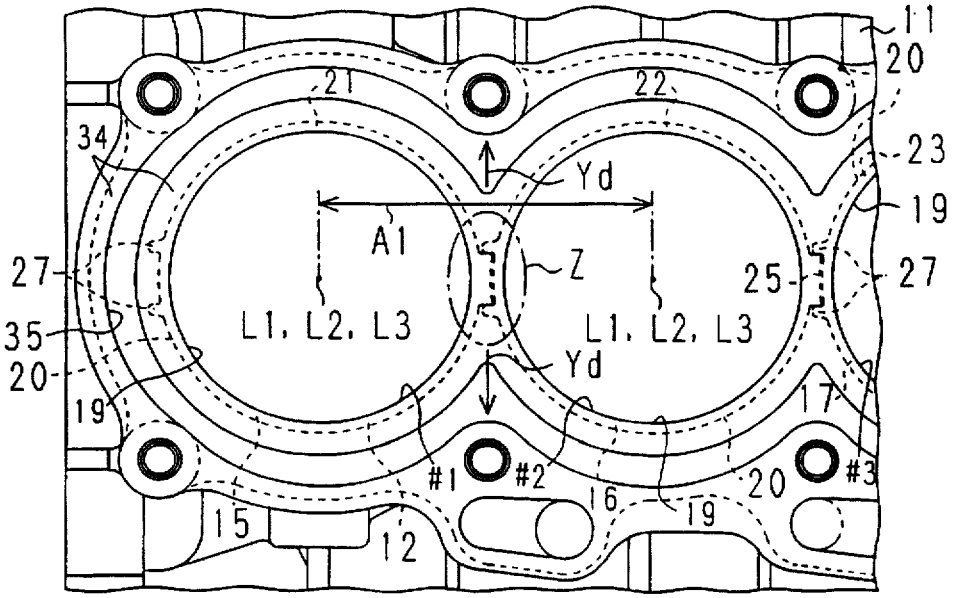
FIG. 9 is a partial plan view showing the cylinder block.
Figure 11:
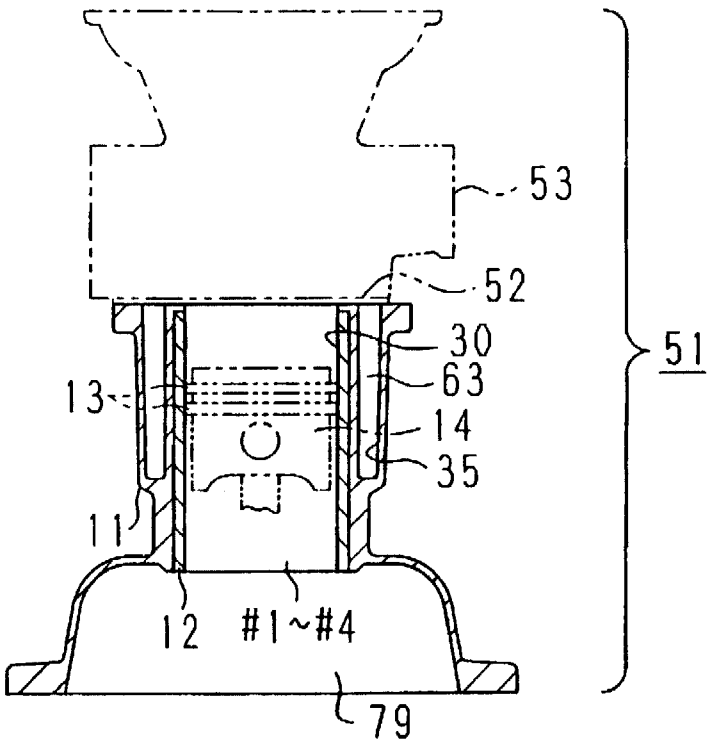
FIG. 11 is a partial cross-sectional side view showing the cylinder block.

FIGS. 9 and 11 show a cylinder block 11 for a four cylinder engine. The cylinder block 11 includes a liner assembly 12 having four cylinder bores #1, #2, #3, #4. As shown in FIG. 11, a piston 14 provided with piston rings 13 is accommodated for reciprocation in each bore #1–#4. The distance between adjacent bores #1–#4 at the closest section is five to eight millimeters and thus very narrow. A combustion chamber 30, in which a mixture of air and fuel is combusted, is defined by the space above the piston 14 in each bore #1–#4. The cylindrical surface of each bore #1–#4 has a high accuracy (roundness) to seal the combustion chamber and prevent the leakage of gas produced by the combustion of the air-fuel mixture.

Figure 1:
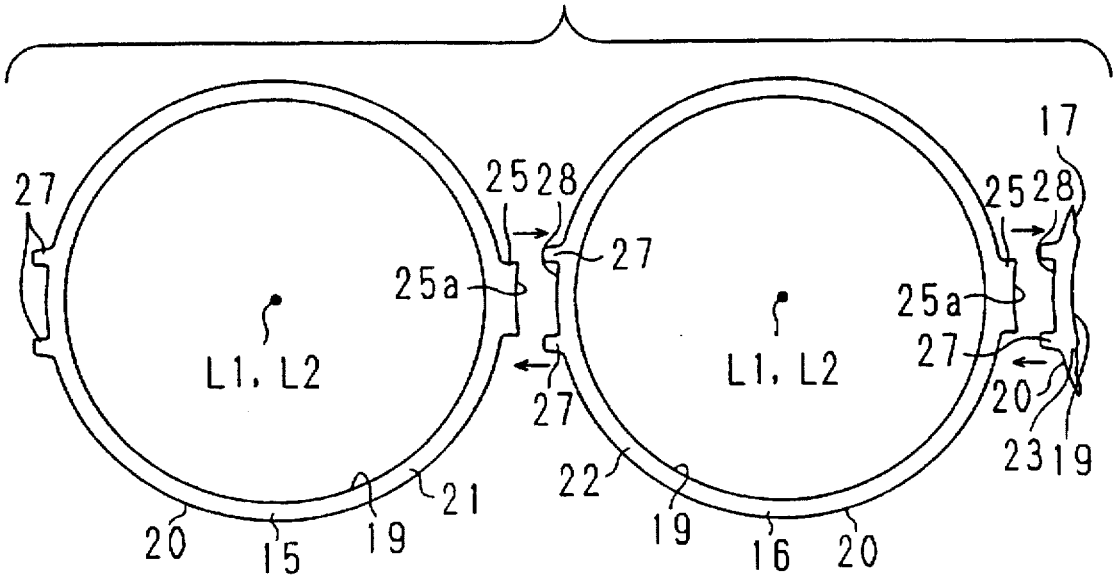
FIG. 1 is a plan view showing cylinder liners according to a first embodiment of the present invention.
Figure 2:
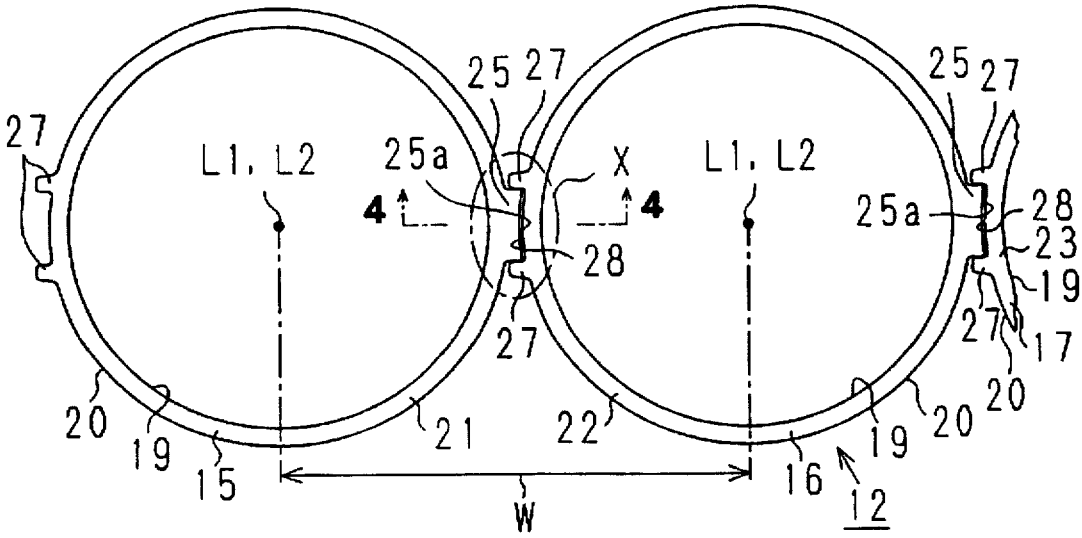
FIG. 2 is a partial plan view showing a liner assembly.
Figure 6:
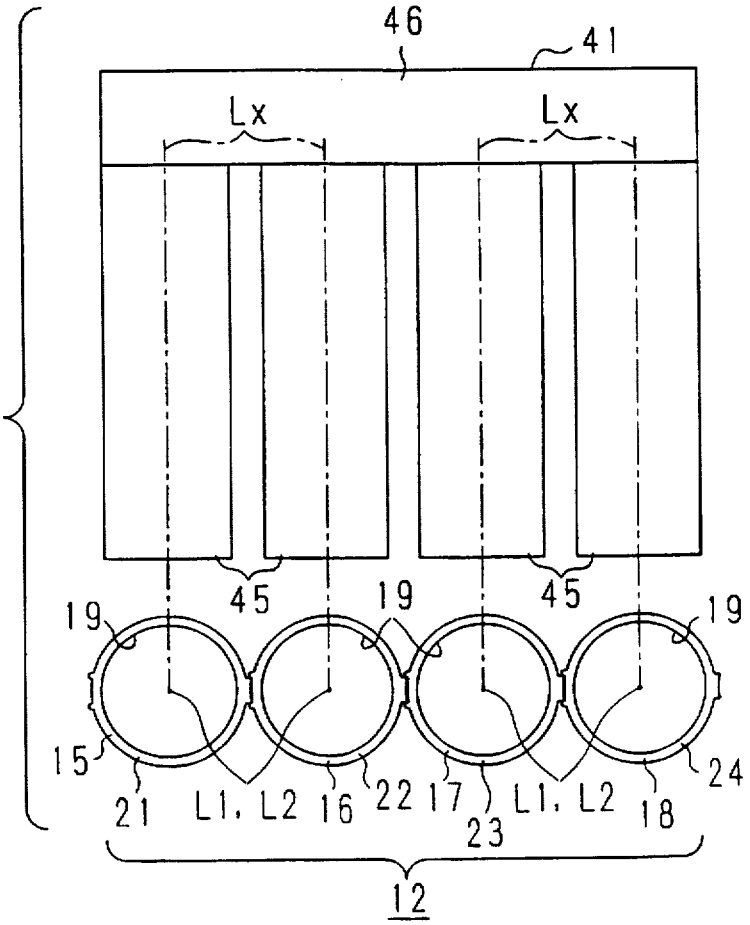
FIG. 6 is an schematic drawing showing an insertion pin and the liner assembly.

As shown in FIGS. 2 and 6, the liner assembly 12 is machined to define the cylinder bores #1–#4. More specifically, the liner assembly 12 includes first, second, third, and fourth cylinder liners 15, 16, 17, 18.

Figure 3:
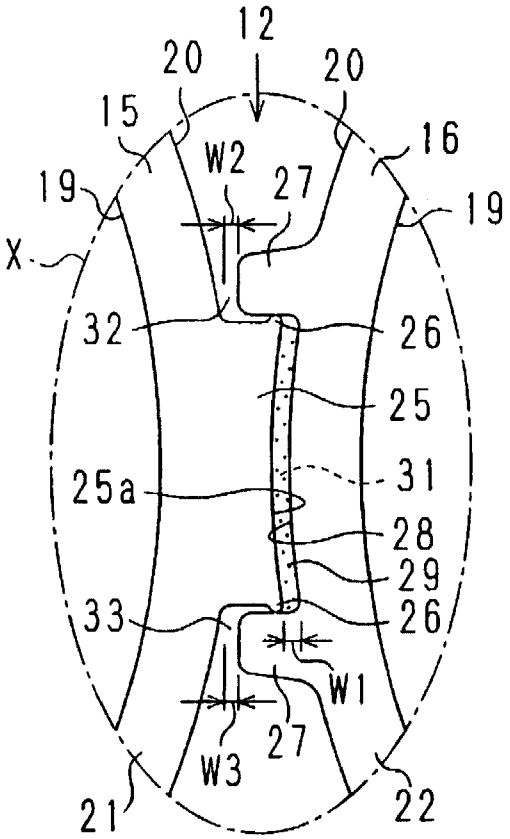
FIG. 3 is an enlarged view showing the portion indicated as X in FIG. 2.

The cylinder liners 15, 16, 17, 18 have cylinders 21, 22, 23, Z4, respectively. One first projection 25 and two second projections 27 project outward from each liner 15–18. Each cylinder 21–24 has an outer cylindrical surface 20 and an inner cylindrical surface 19. The axis L2 of the outer surface 20 coincides with the axis L1 of the associated inner surface 19. The first and second projections 25, 27 relocated along the outer wall 20 at diametrically opposed positions with respect to the axes L1, L2. The first projection 25 projects from the outer surface 20 and extends parallel to the axes L1, L2. A surface 25*a* is defined at the distal end of the first projection 25 arched in correspondence with the shape of the outer surface 20 Of the adjacent cylinder 22 (or 23). As shown in FIG. 3, a finger 26 projects from each side of the arched surface 25*a*. Each finger 26 is tapered to be more narrow toward its end and extends parallel to the axes L1, L2. The widest part of each projection 25 is located between the fingers 26.

The two second projections 27 are separated from each other and project outward from the outer surface 20 extending parallel to the axes L1, L2. The distance between the two projections 27 is slightly smaller than the distance between the tips of the two fingers 26 of projection 25. A receptacle 28 is defined between the two projections 27 and the outer surface 20. To connect adjacent cylinder liners 15–18 to one another, the first projection 25 is press fitted into the receptacle 28 of the adjacent liner 15–18. Three spaces 31, 32, 33 are provided between each adjacent pair of connected liners 15–18 to alter the distance W (FIG. 2) between the axes L2. The space 31 is defined between the arched surface 25*a* and the opposed wall of the receptacle 28. The spaces 32, 33 are defined between the distal end of each second projection 27 and the opposed outer surface 20 of the adjacent cylinder 21–24.

The first projection 25 of each cylinder liner 15–18 is engaged with the receptacle 28 of the adjacent liner 15–18 to connect the liners 15–18 and form the liner assembly 12.

As shown in FIG. 9, the cylinder block 11 includes an aluminum block body 34 molded about the liner assembly 12. The block body 34 is provided with a water jacket 35 defined about the liner assembly 12 in a manner encompassing each cylinder bore #1–#4. Coolant flows through the water jacket 35 to cool the block body 34 and the liner assembly 12.

It is necessary that the cylinder liners 15–18 satisfy the following requirements. (1) wear caused by the repetitive reciprocation of the associated piston in the liners 15–18 must be suppressed without etching or treating the surface of the liners 15–18 to improve wear resistance. (2) Seizing of the pistons 14 must be prevented despite their repetitive reciprocation. (3) The hardness of the base material of the cylinder liners 15–18 must not be lowered by the heat emitted from the molten metal during molding of the cylinder block 11. (4) Strength and toughness must be sufficient to resist the molding pressure. (5) Production in the same manner as cylinder liners made of cast iron must be possible. This enables the employment of the same equipment use to produce cast iron cylinder liners.

It is difficult for a single metal material to satisfy each of the above requirements (1) to (5). Thus the cylinder liners 15–18 in this embodiment are made of a composite material. That is, each cylinder liner 15–18 has a double layer structure that includes an inner layer and an outer layer. The outer layer is made of an aluminum alloy and bonded with the inner layer.

The method for manufacturing the above cylinder block 11 will now be described. The method includes a step (A) to form the cylinder liner, a step (B) to form the liner assembly, a step (c) to arrange the liner assembly in a mold, a step (D) to form the block body, and a step (r) to form the cylinder bores.

Cylinder Liner Formation Step (A)

In step (A) , a matrix powder of a composite metal, alumina, and graphite are uniformly mixed. Billets having holes are produced from the mixture by performing cold isostatic press (CIP). The billets are put inside a container made of an aluminum alloy and then heated. The composite billets are than filled into a mold having a shape that matches the cylinder liners 15–18. The billets are than pressurized and extruded from the mold. This causes metallic Bonding between the powders and allows production of an elongated product having a double-layer structure. By cutting the elongated product into predetermined lengths, cylinder liners having the cylinder and the first and second projections are obtained. The axis of the outer cylindrical surface coincides with the axis of the inner cylindrical surface for each cylinder. Furthermore, the thickness of the wall of the cylinder is uniform.

Liner Assembly Formation Step (B)

In step (B), the four liners 15–18 obtained in step (A) are connected to one another so as to align the cylinders 21–24 in a single row. More specifically, the first projection 25 is press fitted into the receptacle 28 of the adjacent cylinder 15–18 with a silicone adhesive applied between the arched surface 25*a* of the first projection 25 and the second projections 27 of the adjacent cylinder liner 15–18. This connects adjacent cylinders 15–18 as shown in FIGS. 2 and 3. When connecting the adjacent cylinders 15–18, the distal ends of the two fingers 26 linearly contact the associated second projection 27 as the first projection 25 is fitted into the receptacle 28. In other words, there is no planar contact between the sides of the first projection 25 and the second projections 27.

Figure 4:
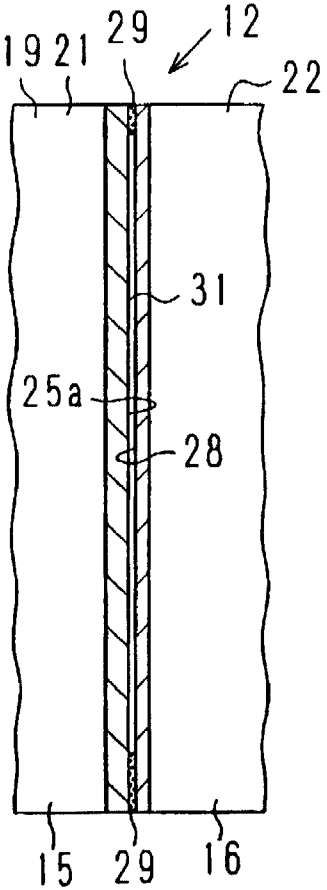
FIG. 4 is cross-sectional view taken along line 4—4 in FIG. 2.

The same procedure is carried out on each cylinder liner 15–18. An adhesive layer 29 is defined between the engaged first projection 25 and the receptacle 28 of the adjacent cylinder liners 15–18 as shown in FIGS. 3 and 4. In the liner assembly 12, the cylinder liners 15–17 are relatively movable along the aligned direction of the cylinders 21–24, that is, toward and away from one another. The movement allows alteration or the distance W between the names L2 of the outer surfaces 20 of each pair of adjacent cylinders 21–24.

Liner Assembly Positioning Step (C)

Figure 5:
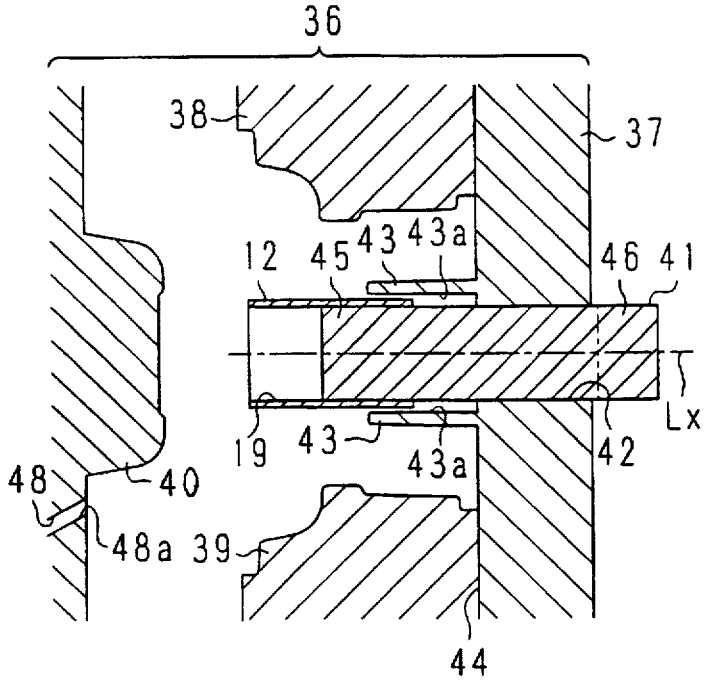
FIG. 5 is a partial cross-sectional view showing a mold in an opened state.

In step (C) and the following step (D), a mold 36 illustrated in FIGS. 5 and 6 is employed. The mold 56 include a fixed mold 37, an upper movable mold 38, a lower movable mold 39, a lateral movable mold 40, and a holding mechanism 41. The fixed mold 37 has a plurality of holes 42 (the number of which corresponds to the number of the cylinders in the engine). A molding projection 43 is provided on a side surface 44 of the fixed mold 37 surrounding each hole 42 to form the water jacket 35.

The upper movable mold 38 is arranged above the molding projection 43 while the lower movable mold 39 is provided below the same projection 43. The movable molds 38, 39 slide reciprocally in a vertical direction along the side surface 44. This allows the movable molds 38, 39 to approach or move away from the molding projection 43. The lateral movable mold 40 is supported in a manner enabling reciprocal movement in the horizontal direction. This allows the movable mold 40 to approach or move away from the fixed mold 37.

The holding mechanism 41 holds the liner assembly 12 arranged in the mold 36. The mechanism 41 includes a plurality of insertion pins 45 (the number of which corresponds to the number of the cylinders in the engine) and connecting sections 46, which connect the basal section of each pair of adjacent pins 45. The pins 45 and the connecting sections 46 are formed integrally. Each pin 45 is cylindrical and has a diameter that is slightly smaller than the diameter of the inner cylindrical surface 19 of the associated cylinder 21–24. Each pin 45 is inserted in each hole 42 and is fixed to the fixed mold 37.

To position the liner assembly 12 in the mold 36, the three movable molds 38–40 are moved away from the projections 43 to open the mold 36 as shown in FIG. 5. The liner assembly 12 is inserted into the space 43*a* defined between the corresponding projection 43 and pin 45. This causes the liner assembly 12 to be fitted on the pins 45.

The linear contraction of the molten metal in the following step (D) is smaller than the widths W1, W2, W3 of the respective spaces 31, 32, 33, which are shown in FIG. 3. That is, as shown in FIG. 9, if he distance between the axes L3 of the adjacent cylinder bores #1–#4 (the bore pitch) i represented by A1, the distance W between the axes L2 of the outer cylindrical surface 20 when the liner assembly 12 is attached to the pins 45 may be represented by A1+α. The cylinder liners 15–18 may be moved toward each other to shorten the distance W.

Block Body Formation Step (D)

Figure 7:
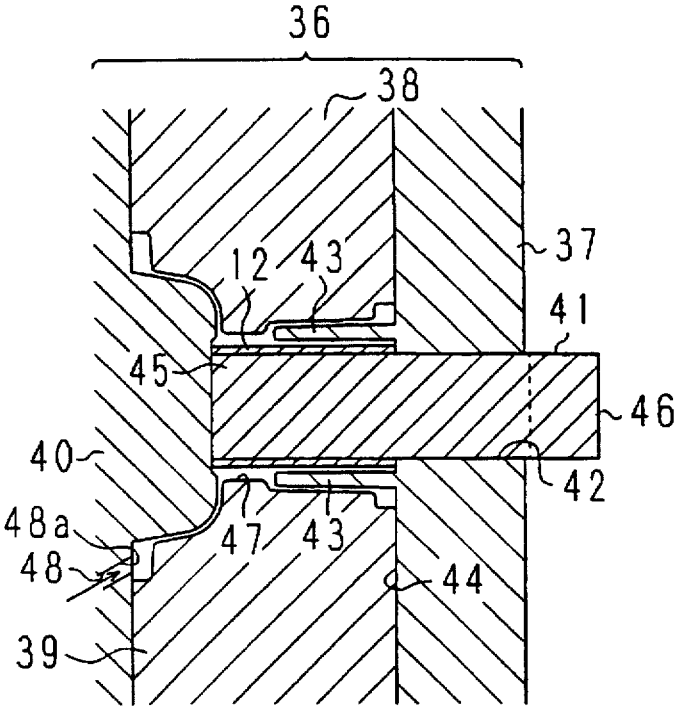
FIG. 7 is a partial cross-sectional view showing the mold in a closed state.

In step (D), the liner assembly 12 is insert molded in aluminum. More specifically, as shown in FIG. 7, the movable molds 38–40 are moved toward the projections 43. This closes the mold 36 and defines a cavity 47 between the fixed mold 37, the movable molds 38–40, and the liner assembly 12. The block body 34 is formed in the cavity 47. Molten metal is charged into the cavity 47 through a passage 48 defined in the lateral movable mold 40.

The molten metal charged in the cavity 47 contracts 0.6% as it solidifies and produces stress that is applied to the cylinder liners 15–18 The stress causes the cylinder liners 15–18 to follow the contraction of the metal and move in a direction narrowing the distance W (FIG. 2) between the axes L2 of each pair of adjacent liners 15–18. The narrowing direction is a direction that the axis L2 of each liner 15–18 moves in as if moves toward the axis L3 of each cylinder bore #1–#4. The bores are formed in the following step (S). When the molten metal is solidified, a rough block material 49 is produced with the liner assembly 12 insert molded in a metal material (aluminum), and the water jacket 35 is defined about the assembly 12. In the block material 49, the axes L2 of the outer cylindrical surfaces 20 of the cylinders 21–24 coincide with the axes L3 of the associated cylinder bores #1–#4.

Figure 8:
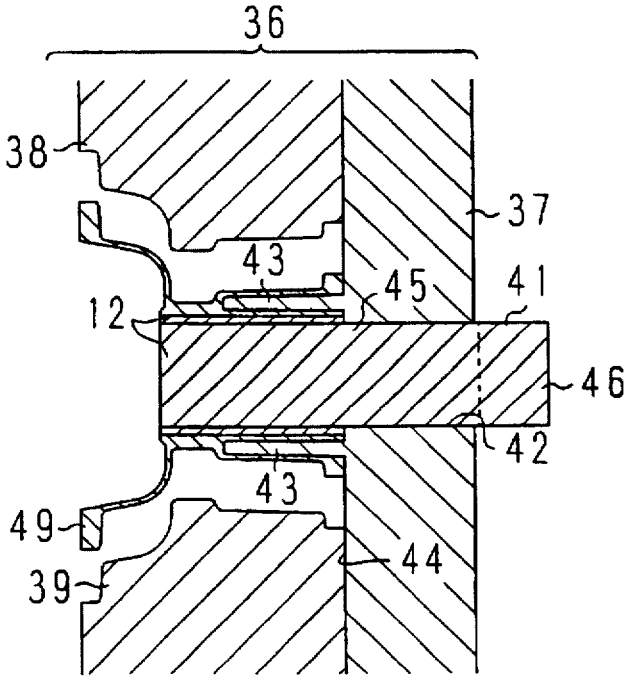
FIG. 8 is a partial cross-sectional view showing a molded rough block material in the mold.

As shown in FIG. 8, the movable molds 38–40 are then moved away from the molding projections 43. The block material 49 is than pushed out of the mold 36 by pushing pins (not shown).

Cylinder Bore Formation step (E)

Figure 10:
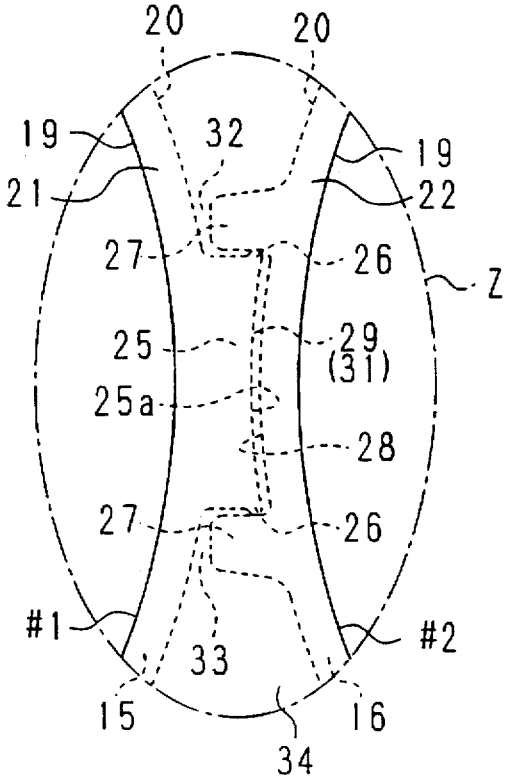
FIG. 10 is an enlarged view showing the portion indicated by Z in FIG. 9.

In step (E), the inner cylindrical surface 19 of each cylinder 21–24 is machined about a point that is separated by a predetermined distance from a reference position on the block body 34. As mentioned above, the axes L1, L2 of the outer and inner surfaces 19, 20 of each cylinder 21–24 are displaced by the contraction of the molten metal during solidification. As shown in FIGS. 9 and 10, this enables each cylinder bore #1–#4 to have a predetermined radius with its axis L3 coinciding with the axis L2 of the inner surface 20 when machined. After machining, the wall thickness of each cylinder 21–24 is uniform. This allows the produced cylinder block 11 to have a structure that does not include sections that are weaker than other sections. Thus, the cylinder block 11 differs from the cylinder blocks of the prior art.

AS shown in FIG. 11, in an engine 51, a cylinder head 53 is installed on the cylinder block 11 by way of a gasket An oil pan (not shown) is arranged under the cylinder block The pistons 14 are accommodated in the associated cylinder bores #1–#4. When the engine 51 is started, the air-fuel mixture in the combustion chambers 30 is ignited and combusted. This vertically reciprocates the pistons 14 in the associated cylinder bores #1–#4.

In this embodiment, each cylinder liner 15–18 is 53 constituted by the respective cylinder 21–24, the first projection 25, and the second projections 27. Accordingly, adjacent cylinder liners 15–18 may be connected to each other simply by engaging the first projection 25 with the receptacle 28. In addition, the structure produces the spaces 31–33, which serve as a variable section.

All of the cylinder liners 15–18 have identical shapes. This allows common parts to be used at different locations and reduces the number of different parts.

When engaging each first projection 25 with the associated receptacle 28, the fingers 26 of the projection 25 contact the associated second projections 27 linearly. Thus, the small contact area between the first projection Z5 and the receptacle 28 reduces friction therebetween. As a result, this facilitates the relative movement of the cylinder liners 15–18o Accordingly, the cylinder liners 15–18 may move relative to one another when the molten metal solidifies and contracts.

Since the distance A1 between the axes L3 of each pair of adjacent cylinder bores #1–#4 becomes smaller, the entire length of the cylinder block 11 (the length of the block 11 in the aligned direction of the cylinders 21–24) is shortened. This shortens the length of the engine 51 and allows a reduction in the weigh of the engine 51. Furthermore, this lessens the restrictions on mounting the engine on the vehicle caused by the size of the engine 51.

There are a few problems caused when insert molding a block body about a plurality of adjacent cylinder liners without the projections, As the molten metal solidifies, stress is applied to the metal material causing it to move from between each pair of adjacent cylinders (i.e., movement in the direction indicated by arrows Yd in FIG. 9). This may cause cracks in the metal material at positions where the space between the cylinders becomes most narrow. As he space between the cylinders becomes more narrow, the metal material is more apt to crack.

However, in this embodiment, the projections 25, 27 are provided at the location where the space between adjacent cylinders is most narrow. The projections 25, 27 are rigid and the adjacent cylinders liners 15–18 are securely connected to one another by the projections 25, 27. Therefore, cracks are not formed in the metal material regardless of the application of stress in the direction indicated by arrows Yd during solidification.

The insertion pins 45 may securely be engaged with the corresponding cylinder liners 15–18 of the liner assembly 12. As shown in FIGS. 5 and 6, the distance between the axes Lx of each pair of adjacent pins 45 varies as the temperature changes. Thermal expansion increases as the temperature of the mold 36 rises resulting in an increase in the distance between the axes Lx. The time elapsed after the molten metal is charged into the mold 36 effects the temperature of the mold 36. The temperature becomes highest immediately after the molten metal is charged and becomes lower as time elapses. Accordingly, the distance between each pair of adjacent axes Lx varies from when the molten metal is charged into the mold 36 in the previous molding cycle to when the liner assembly 12 is positioned in the present molding cycle. In such case, the axis of each pin and the axis of the corresponding cylinder liner become misaligned if the cylinder liners are securely fixed to one another to form the liner assembly. This may obstruct the engagement between the liner and the corresponding pins 45.

However, in this embodiment, the spaces 31–33 provided between each pair of adjacent cylinder liners 15–18 allow the liners 15–18 to move in a direction that varies the distance W between the axes L2 of the adjacent liners 15–18. The position of the cylinder liners 15–18 may be varied to coincide the axis L2 of each liner 15–18 with the axis Lx of the corresponding pin 45 despite changes in the distance between adjacent axes Lx. The alignment of the corresponding axes Lx enables the liner assembly 12 to be engaged with the pins 45.

The cost of forming the cylinder liners 15–18 and the liner assembly 12 is reduced by the structure of this embodiment. That is, the first and second projections 25, 27 serve to connect the adjacent liners 15–18 while also serving to define a variable section (spaces 31–33). In comparison with a structure providing separate parts that only have a single purpose, the structure of this embodiment provides parts that have multiple functions and thus saves material costs.

If a liner assembly is not provided with the variable section, its overall length is fixed. In this case, molten metal may enter the space defined between the section connecting adjacent liners. To prevent this problem, it is required that the connecting section of each liner have a fine surface. Thus, it is necessary to machine the connecting section to provide a fine surface finish. However, in this embodiment, the connecting section of each cylinder 21–24 is provided with the spaces 31–33. The connecting sections of the cylinder 21–24 need not be accurately machined to produce these spaces 31–33. Thus, machining to obtain a fine surface finish for the connecting sections is not required.

Furthermore, the projections 25, 27 are formed through extrusion in the molding step (A) of the cylinder liners 15–18. Thus, no machining of the projections 25, 27 is required.

As described above, the structure of this embodiment saves material costs. In addition, machining to improve the surface roughness of the assembly and to form the projections 25, 27 is not necessary, This contributes to reducing manufacturing costs.

If the molten metal enters each space 31–33, the metal may restrict the movement of the cylinder Liners. However, in this embodiment, the adhesive layer 29 seals each space 31–33 and prevents molten metal from entering therein. This enables smooth relative movement of the cylinder liners 15–18. The adhesive layer 29 remains flexible until the molten metal solidifies. Thus, the adhesive layer 29 does not hinder the relative movement of the cylinder liners 15–18.

When the cylinder block is made of aluminum, it is required that the pistons and the piston rings slide smoothly with respect to the associated cylinder bores. To enable smooth sliding, the walls of the cylinder bore may be nickel-plated or provided with a layer of metal matrix composite (MMC). The cylinder bore walls may also be etched with a high silicon alumina alloy (A390). In such cases, the manufacturing methods such as low pressure casting or low speed medium pressure casting are employed to ensure the quality of the walls of the cylinder bores. However, these manufacturing methods increase the thickness of the molded product and thus increase the weight of the cylinder block. Furthermore, these methods l n then the time required during the casting cycle.

To cope with this problem, the cylinder liners 15–18 have a double layer structure consisting of the inner and outer layers to secure the strength and toughness that is equal to that of cylinder liners made of cast iron. This allow the liner assembly 12 to be insert molded during the die casting process. In addition, this minimizes investments in equipment that are required to manufacture the cylinder block 11 of the present invention. Furthermore, since the die casting method may be employed, the average thickness of the cylinder block 11 may be minimized. This reduces the weight of the block 11 and shorten the time required for the casting cycle.

A second embodiment according to the present invention will hereafter be described with reference to FIGS. 12–19.

In this embodiment, the method through which the variable section in the liner assembly is formed differs from the first embodiment. Additionally, a plurality of serrations are provided on the outer cylindrical surfaces 20 of the cylinder 21–24 and a coolant passage is provided between the sections connecting the adjacent cylinder liners 15–18. These differing parts will be described below. Parts that are identical to those in The first embodiment will be denoted with the same numeral.

Figure 13:
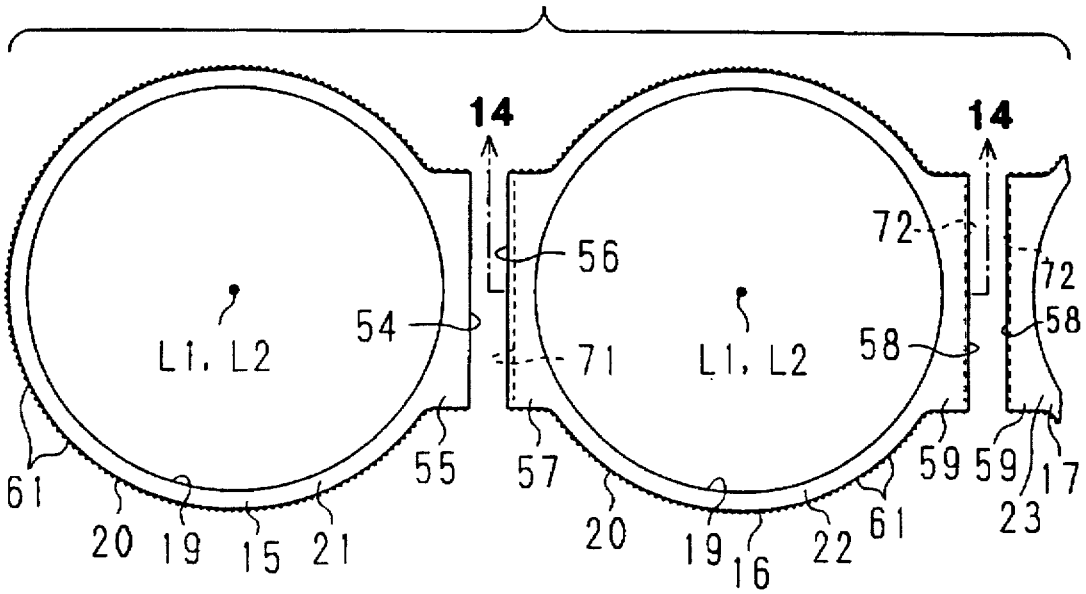
FIG. 13 is a plan view showing the cylinder liners.
Figure 18:
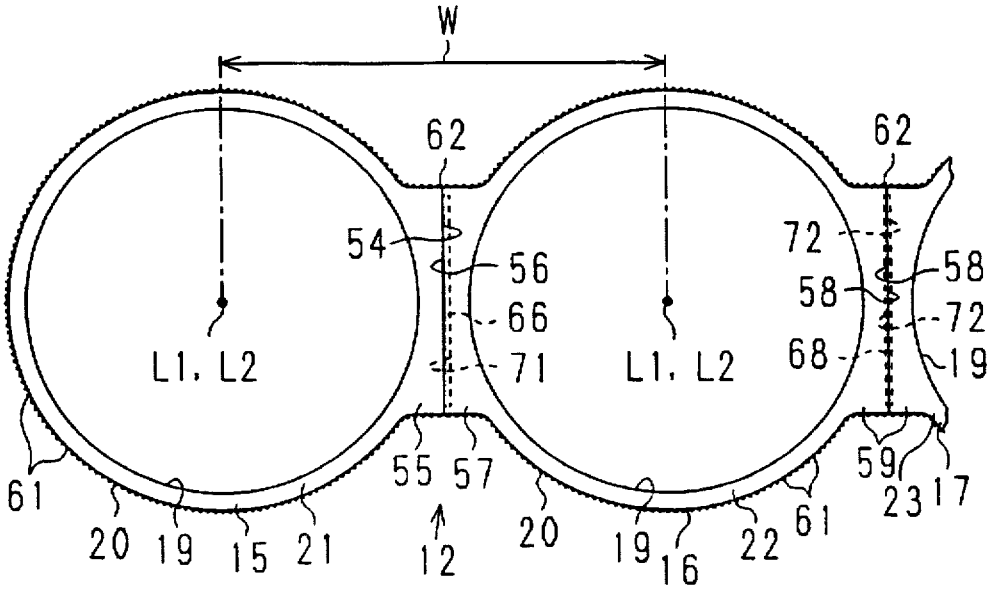
FIG. 18 is a partial plan view showing a liner assembly.

As shown in FIGS. 13 and 18, the cylinder liners 15–18 are not identical to one another. The first cylinder liner 15, located at one end of the liner assembly 12 and the fourth cylinder liner (not shown), located at the other end of the same assembly 12, have identical shapes. The second cylinder liner 16 and the third cylinder liner 17, located between the first cylinder liner 15 and the fourth cylinder liner, have identical shapes. The fourth liner is rotated 180 degrees with respect to the first liner 15. The third liner 17 is rotated 180 degrees with respect to the second liner 16. In this manner, the liner assembly 12 is constituted by two types of cylinder liners.

The first liner 15 and the fourth liner each have a cylinder 21 having a outer and inner cylindrical surfaces 20, 19, a cylinder 21, and a connecting section 55 to connect the cylinder 21 with the adjacent cylinder 21. The axis L2 of the outer cylindrical surface 20 coincides with the axis L1 of the associated inner cylindrical surface 19. The connecting section 55 projects radially outward from each cylinder 21 and has a flat abutting surface 54 defined at its distal end. The second and third liners 16, 17 each have a respective cylinder 22, 23 and connecting sections 57, 59. The cylinders 22, 23 each have outer and inner cylindrical surfaces 20, 19. The connecting sections 57, 59 connect the cylinders 22, 23 to the adjacent cylinders 21, 24, respectively. The axis L2 of the outer cylindrical surface 20 coincides with the axis L1 of the associated inner cylindrical surface 19. The connecting sections 57, 59 project radially outward from the cylinders 57, 59 in opposite directions. The connecting sections 57, 59 have respective flat abutting surface 56, 58 defined at their distal end. A plurality of serrations 61 extend parallel to the axes L1, L2 on the outer cylindrical surface 20 of each cylinder 21–24.

Figure 12:
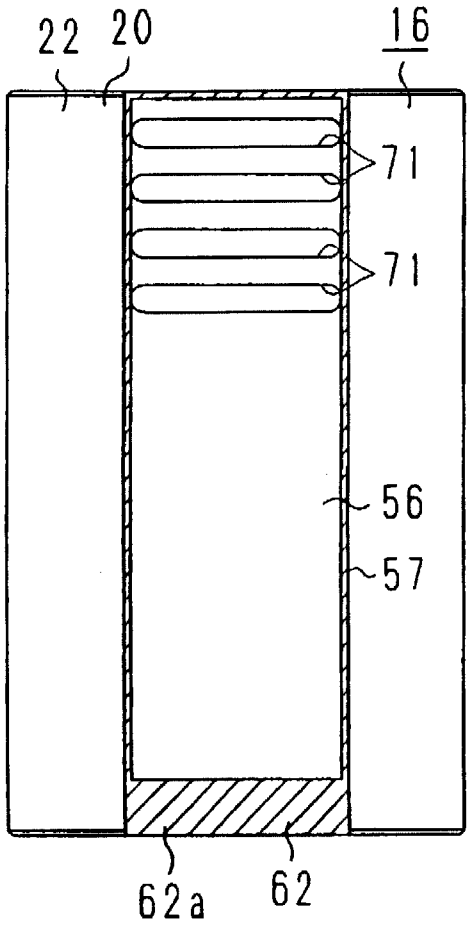
FIG. 12 is a cross-sectional view showing a left side view of a cylinder liner according to a second embodiment, of the present invention.

In this embodiment, an adhesive is used to connect the four cylinder liners 15–18 to one another and define the variable section. More specifically, an adhesive layer 62 is provided between the opposed abutting surfaces 54, 56 of each pair of adjacent connecting sections 55, 57. An adhesive layer 62 is also provided between the opposed abutting surfaces 58 of the connecting sections 59, 59 projecting from the second and third liners 16, 17, respectively. As shown in FIG. 12, the adhesive layer 62 is formed by applying the adhesive around the abutting surfaces 54, 96, 58 in a substantially rectangular frame-like manner. The lower section **62*a* of the adhesive layer 62 has a greater area than other sections of the same layer 62*a*. Each adhesive layer 62 enables relative movement of the cylinder liners 15–18 in a direction narrowing the distance W between the axes L2 of the adjacent liners 15–18** when the molten metal contracts as it solidifies.

It is necessary that the adhesive layer 62 satisfy the following requirements. The layer 62 must connect the abutting surfaces 54, 56, 58 of the respective connecting sections 55, 57, 59 to connect adjacent liners 15–18 with each other. The layer 62 must have flexibility during the process in which the molten metal solidifies and contracts. The layer 62 must resist the instantaneous high temperature and high pressure during molding to prevent the molten metal from entering the space between the connecting sections 55, 57, 59. To satisfy these requirements, the employment of a silicone adhesive is desirable in this embodiment.

As shown in FIGS. 15, 16, 17, and 19, coolant passages 64, 65 are provided so that the coolant 63 in the water jacket 35 is drawn into the area between each pair of adjacent cylinder bores #1, #2, #3, #4. Each coolant passage 64 includes a plurality (four) of rectangular closed spaces 66, which are laterally elongated, and pairs of holes 67, each extending vertically through the sides of each set of closed spaces 66. The closed spaces 66 are provided at the upper portion of the a adjacent connecting sections 55, 57. Each hole 67 connects the closed spaces 66 to the water jacket 35. The coolant passage 65 includes a plurality (four) of rectangular closed spaces 68, which are laterally elongated, and pairs of holes 69, each extending vertically through the sides of the closed spaces 68. The closed spaces 68 are provided at the upper portion of the adjacent connecting sections 59. Each hole 69 connects the closed spaces 68 to the water jacket 35.

Figure 14:
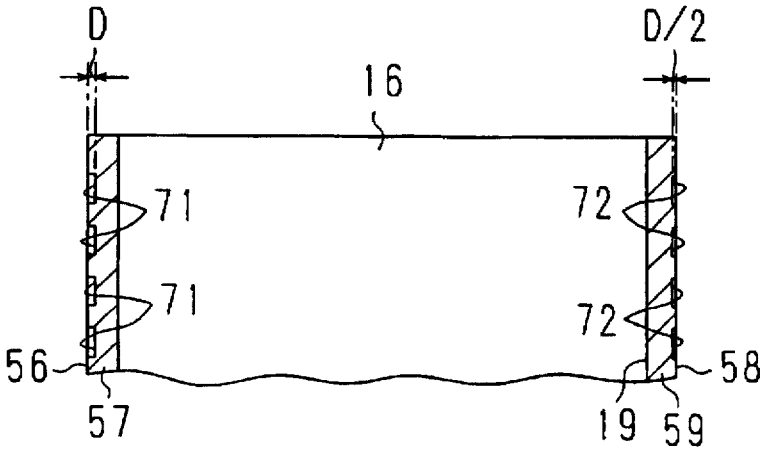
FIG. 14 is a cross-sectional view taken along line 14–14 in FIG. 13.

A plurality (four) of grooves 71 extend between the sides of the abutting surface 56 at the upper portion of the second cylinder liner 16 to define the closed spaces 66. As shown in FIGS. 13 and 14, each groove 71 has a depth D and extends in a direction perpendicular to the axes L1, L2. The abutting surface of the third cylinder liner 17 is provided with identical grooves (not shown). The abutting surfaces 54 of the first and fourth cylinder liners 15, 18 are not provided with such grooves. The closed spaces 66 having a predetermined width are defined between the grooves 71 and the opposed abutting surface 54 when connecting the first and second cylinder liners 15, t6 or the fourth and third cylinder liners 18, 17 with the adhesive layers 62.

A plurality (four) of grooves 72 extend between the sides of the abutting surfaces 56, 58 at the upper portion of the second and third cylinder liner 16, 17. Each groove 72 has a depth D/2 which is half the depth D of the grooves 71 and extends in a direction perpendicular to the axes L1, L2. The closed spaces 68 having a predetermined width are defined between the opposed grooves 72 when connecting the second and third cylinder liners 16, 17 to each other.

The structure of this embodiment minimizes machining of the cylinder liners 15–18 that is required to define the closed spaces 66, 68 and enables, the closed spaces 66, 68 to be defined halfway between the adjacent cylinder bores #1–#4. By providing the closed spaces 66, 58 at the halfway point between the adjacent cylinder bores #1–#4 , the distance between the coolant passages 64, 65 and the bores #1–#4 is equalized. This allows uniform cooling of the adjacent bores #1–4.

Since the temperature at the upper portion of each abutting surface 54, 56, 58 becomes highest when the engine is running, the grooves 71, 72 are provided only at the upper section of each abutting surface 54, 56, 58. Without the coolant passages 64, 65, the cooling effect of the coolant flowing through the water jacket 35 may be insufficient. In other words, heat is produced during operation of the engine 51 when the air-fuel mixture is ignited and combusted in each combustion chamber 30. Since each combustion chamber 30 is defined at the section above the piston 14, the upper portion of each cylinder liner 15–18 is heated by the heat of the chamber 30. The effects of the combustion heat become smaller at positions lower than the combustion chambers 30. Thus, the lower portions of the cylinder liners 15–18 may be sufficiently cooled by the coolant flowing through the water jacket 35. Accordingly, the coolant passages 64, 65 need not be provided between the lower portions of the adjacent bores #1–#4.

The steps of the method to manufacture the cylinder block 11 in this embodiment will now be described. The method includes the steps (A)–(E) of the first embodiment and a Step (F) in which the holes 67, 69 are formed.

Cylinder Liner Formation Step (A)

In step (A), ballets are produced through the CIP method in the same manner as the first embodiment. The billets are then pressurized and extruded to produce an elongated product having a double-layer structure. By cutting the elongated product into predetermined lengths, cylinder liners having a cylinder and a single connecting section are obtained. Cylinder liners having a cylinder id two connecting sections are also obtained by cutting the elongated product in the same manner. The axis of the outer cylindrical surface coincides with the axis of the inner cylindrical surface for each cylinder. Furthermore, the thickness of the wall of the cylinder is uniform.

Liner Assembly Formation Step (B)

In step (B), two of each type of the cylinder liners obtained in step (A) are connected to one another so as align the cylinder 21–24in a single row. More specifically, a silicone adhesive is applied around at least one of the opposed connecting sections 55, 57 (or 59, 59) of the abutting surface 54, 56 (or 58, 58). For example, as shown in FIG. 12 the adhesive is applied about the abutting surface 56, in which the grooves 71 are defined, in a rectangular frame-like manner. The area of the applied adhesive is larger at the bottom section of each abutting surface 55, 57, 59 than other sections of the same surface 55, 57, 59. Each pair of adjacent connecting sections 55, 57 (or 59, 59) are then adhered to each other by the adhesive. This connects adjacent cylinders 15–18 and defines the liner assembly 12. In the assembly 12, a space corresponding to the thickness of the applied adhesive is defined between each of the connected butting surfaces 54, 56 (or 59, 59). This enables relative movement of the cylinder liners 15–18 along the aligned direction of their cylinders. The movement alters the distance W between each pair of adjacent axes L2.

As shown in FIG. 18, the closed spaces 66, 68 are defined in the connecting sections of the adjacent cylinder liners 15–18 by connecting the opposed abutting surfaces 56 (or 58, 58). That is, the closed surfaces 66 are defined between the abutting surface 54 and the grooves 71 of the associated first and second cylinder liners 15, 16. In the same manner, the closed spaces 66 are defined between the fourth and third cylinder liners 18, 17. The closed spaces 68 are defined between the pair of opposed groove 72, 72 of the second and third cylinder liners 16, 17. Each of the closed spaces 66, 68 has the same volume and is located halfway between each pair of adjacent cylinder bores #1–#4.

Liner Assembly Positioning Step (C)

In step (C), the three movable molds 38–40 are separated from the molding projections 43 in the same manner as the first embodiment. The liner assembly 12 is inserted into the space **43*a* defined between the corresponding projection 43 and pin 46. This fits the liner assembly 12 on the pins 45 and positions the assembly 12 in the mold 36 (refer to FIG. 5). In this state, the distance between the opposed abutting surfaces 54, 56 (or 58, 58) of the adjacent connecting section 55, 57 (or 59, 59) is greater than the linear contraction of the molten metal in the following step (D). In this state, the cylinder liners 15–18** may be moved toward each other to narrow the distance W.

Block Body Formation Step (D)

In step (D), the movable molds 38–40 , are moved toward the projections 43 to define the cavity 47 between the fixed mold 37, the movable molds 38–40, and the liner assembly 12 in the same manner as in the first embodiment. The block body 34 is formed in the cavity 47. Molten metal is charged into he cavity 47 through the passage 48 defined in the lateral movable mold 40 (refer to FIG. 7).

The molten metal charged in the cavity 47 contracts 0.6% as it solidifies and produces stress that is applied to the cylinder liners 15–18. The rectangular frame-like adhesive layer 62 is formed along the periphery of the abutting surface 54, 56, 58 to prevent molten metal from entering the space between the connecting sections 55, 57 or the connecting sections 58, 58. The adhesive layer 62 is made of a silicone resin and is thus flexible. The stress causes the cylinder liners 15–18 to follow the contraction and move relatively in a direction narrowing the distance W between the axes L2 of each pair of adjacent liners 15–18. The adhesive layer 62 is deformed by the relative movement of the cylinder liners 15–18.

When the molten metal is solidified, a rough block material 49 is obtained with the liner assembly 12 insert molded in aluminum and the water jacket 35 defined about the assembly 12. In the block material 49, the axle L2 of the outer cylindrical surface 20 of each cylinder 21–24 coincides with the axis L3 of the associated cylinder bore #1–#4.

As shown in FIG. 8, the movable molds 38–40 are than moved away from the molding projections 43. The block material 49 is than pushed out of the mold 36 by pushing pins (not shown).

In the block material 49, the inner cylindrical surface 19 of each cylinder 21–24 of the liner assembly 12 is exposed. The other parts of the liner assembly 12 are encompassed by the aluminum casting (block body 34). The plurality (four) of closed spaces 66, 68 are defined between each pair of adjacent connecting sections 58, 57 and 59, 59. In this state, the closed spaces 66, 68 are not yet connected with the water jacket 35.

Cylinder Bore Formation Step (E)

Figure 19:
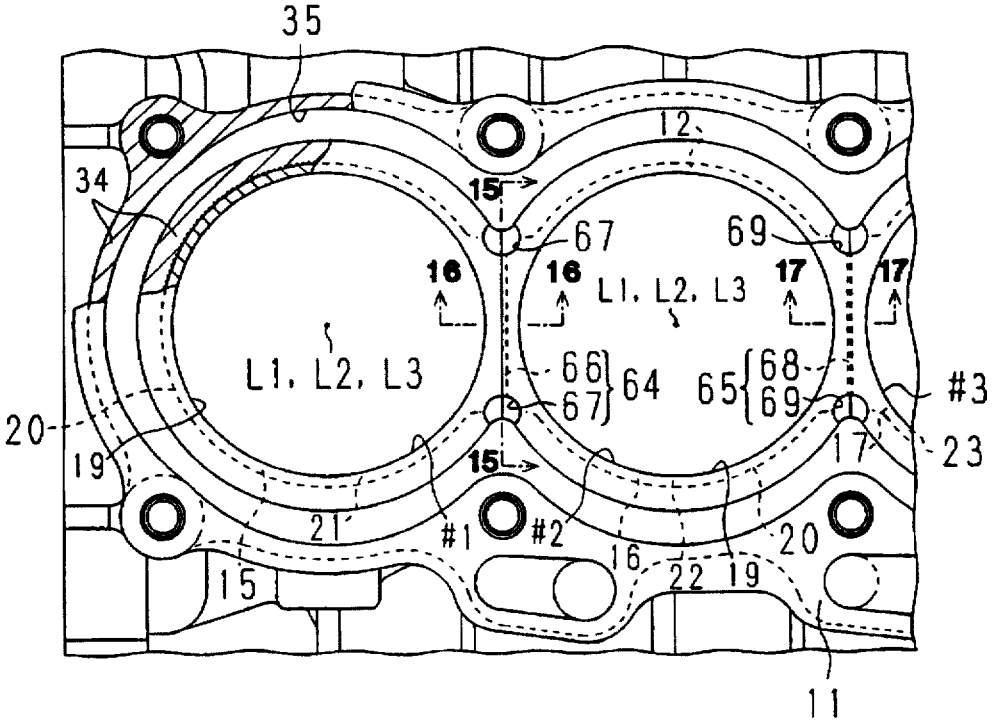
FIG. 19 is a partial plan view showing a cylinder block.

In step (E), the inner cylindrical surface 19 of each cylinder 21–24 is machined about a point that is separated by a predetermined distance from a reference position On the block body 34. As mentioned above, the axes L1, L2 of the outer and inner surfaces 19, 20 of each cylinder 21–24 are displaced by the contraction of molten metal during solidification. As shown in FIG. 19, this enables each cylinder bore #1–#4 to have a predetermined radius and an axis L3 that coincides with the axis L2 of the inner surface 20 when machined. Therefore, the wall thickness of each cylinder 21–24 becomes uniform after machining. As in the first embodiment, this allows the produced cylinder block 11 to have a structure that does not include weaker sections.

Hole Formation Step (F)

In step (F), the sides of the abutted portion of the connecting sections 55, 57 (or 59, 59) are perforated by drills, or the like, to define the holes 67, 69. The holes 67, 69 connect the ends of each closed space 66, 68 with the water jacket 35. The closed spaces 66, 68 and the holes 67, 69 constitute coolant passages 64, 65, respectively, between the bores #1–4.

Figure 15:
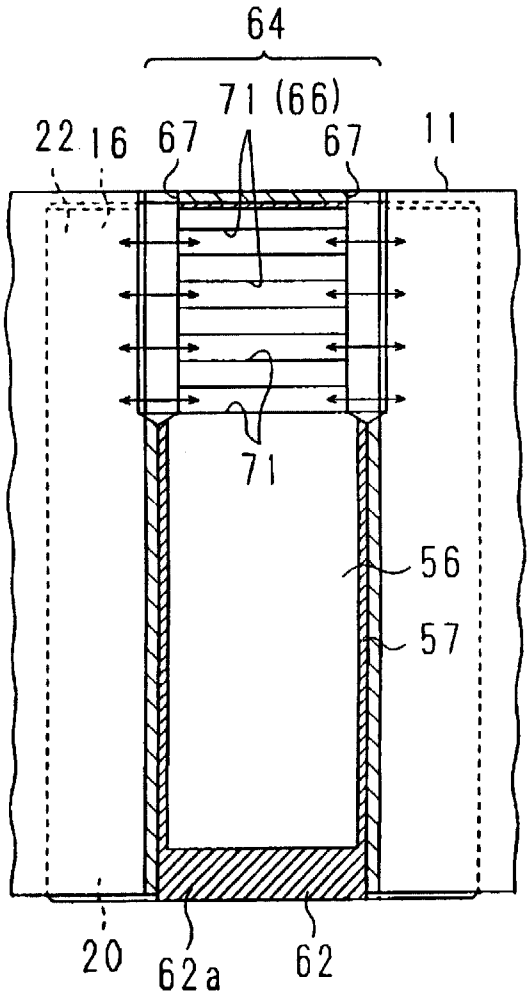
FIG. 15 is a cross-sectional view taken along line 15–15 in FIG. 19.
Figure 16:
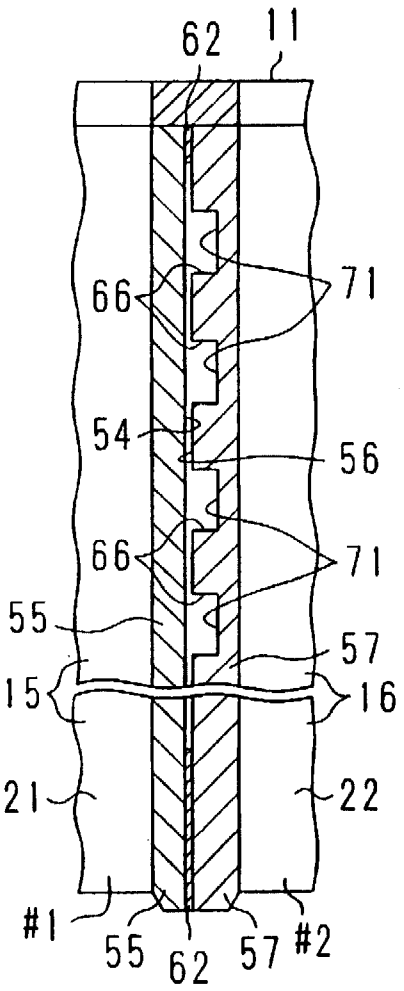
FIG. 16 is a cross-sectional view taken along line 16—16 in FIG. 19.
Figure 17:
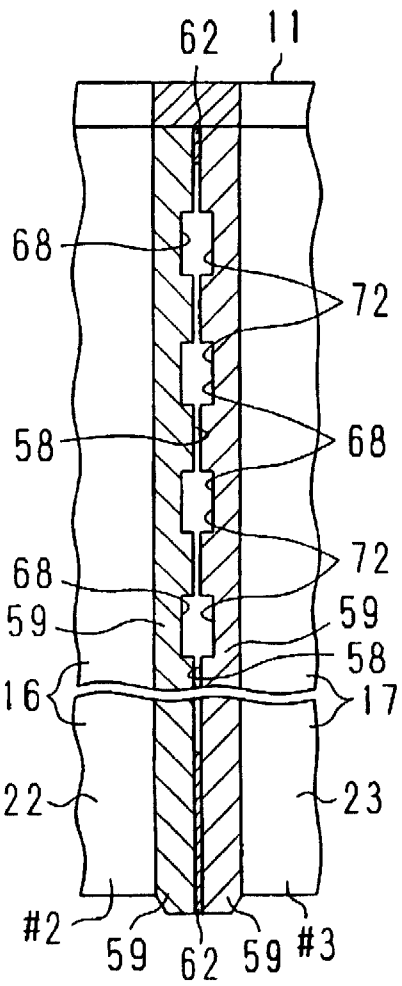
FIG. 17 is a cross-sectional view taken along line 17—17 in FIG. 19.

In the engine 51, which employs the cylinder block 11 of the second embodiment, a portion of the coolant 63 flowing through the water jacket 35 flows through the coolant passages 64, 65 as shown by the arrows in FIG. 15. Heat transfer is performed between the heated cylinder liners 15–18 and the coolant 63 to cool the liners 5–18. In this embodiment, the distance between each bore #1–#4 and the associated coolant passage 64, 65 is equal. Therefore, the coolant 63 flowing through the passages 64, 65 cools the adjacent cylinder liners 15–18 in a uniform manner.

When the liner assembly 12 is arranged in the mold 36, the lower part of the adhesive layer 62, which is closest to a molten metal port 48*a*, receives the high pressure of the molten metal during molding. However, in this embodiment, the lower section 62*a* of the adhesive layer 62 has a greater area than other sections of the same layer 62. Thus, the adhesive layer 62 securely prevent molten metal from entering the space between the connecting sections 55, 57 or 59, 59 despite the high pressure acting against the layer 62.

The molten metal, which is highly pressurized and has a high temperature, contacts the adhesive layer 62 during molding. However, since a silicone adhesive is used as the adhesive, the adhesive layer 62 sufficiently resists the heat of the molten metal.

The adhesive layer 62, which has a predetermined width and flexibility, enables relative movement of the adjacent cylinder liners 15–18 and allows the distance W between their axes L2 to be varied. Thus, the position of the cylinder liners 15–18 may be varied to coincide the axis L2 of each liner 15–18 with the axis Lx of the corresponding pin 45 despite changes in the distance between adjacent axes Lx. Accordingly the liner assembly 12 may securely be engaged with the pins 45 during its positioning step.

If adjacent cylinder liners are fixed to each other in the same manner as the prior art, stress produced by the contraction of the molten metal during solidification may compress and deform the cylinders in their aligned direction. To cope with such deformation, it is necessary to increase the thickness of the cylinder walls at certain sections when the liners are formed in step (A).

In comparison, the deformation of the adhesive layer 62 absorbs the stress produced by the contraction of the molten metal during solidification in the second embodiment. This suppresses deformation of the cylinders 21–24. Accordingly, it is not necessary to increase the thickness of the walls of the cylinders 21–24.

The flexibility of the adhesive layers 62 between the adjacent connecting sections 55, 57 and the connecting sections 59, 59 enables the layer 62 to be securely adhered to the abutting surfaces 54, 56, 58. Hence, the adhesive layer 62 deforms in correspondence with the abutting surfaces 54, 56, 58 even when the surfaces 54, 56, 58 are not flat. Accordingly, the abutting surfaces 54, 56, 58 need not be machined smoothly to prevent space from being defined between the cylinder liners 15–18.

The first and fourth cylinder liners 15, 18 are identical to each other while the second and third cylinder liners 16, 17 are identical to each other. Thus, common parts may be employed to form the liner assembly 12. This reduces the required types of parts. In other words, the four cylinder liners 15–18 may be obtained by producing two types of cylinder liners in the cylinder liner formation step (A).

The abutting surface 54 of the connecting section 55 for the first and fourth cylinder liners 15, 18 are not provided with grooves. This reduces manufacturing steps and saves machining costs that are related to the formation of the closed spaces 66.

The block body 34 and the cylinder liners 15–18 are made of different materials. The difference in the linear expansion coefficient of each material results in the heat the engine 51 producing slight spaces at the section joining the block body 34 to the cylinder liners 15–18. This may degrade the strength holding the cylinder liners 15–18 in the block body 34.

To cope with this, serrations 61 are provided on the outer cylindrical surface of each cylinder 21–24. The serrations 61 enable the cylinder 21–24 to be securely adhered to the block body 34. Hence, the cylinder liners 15–18 are firmly held regardless of the volume expansion of the block body 34 caused by the engine heat.

The closed spaces 66, 68 are defined by the grooves 71, 72. The rigidity of the cylinder in each cylinder liner is improved by this structure in comparison to when the closed spaces are defined by a single recess.

A third embodiment according to the present invention will hereafter be described with reference to FIGS. 20–23.

This embodiment differs from the first and second embodiments in that the length of the connecting sections 59 with respect to the aligned direction of the cylinders 21–24 is constant and that the wall thickness of each cylinder 21–24 is not uniform. Parts that are identical to those used in the second embodiment are denoted with the same numerals.

Figure 20:
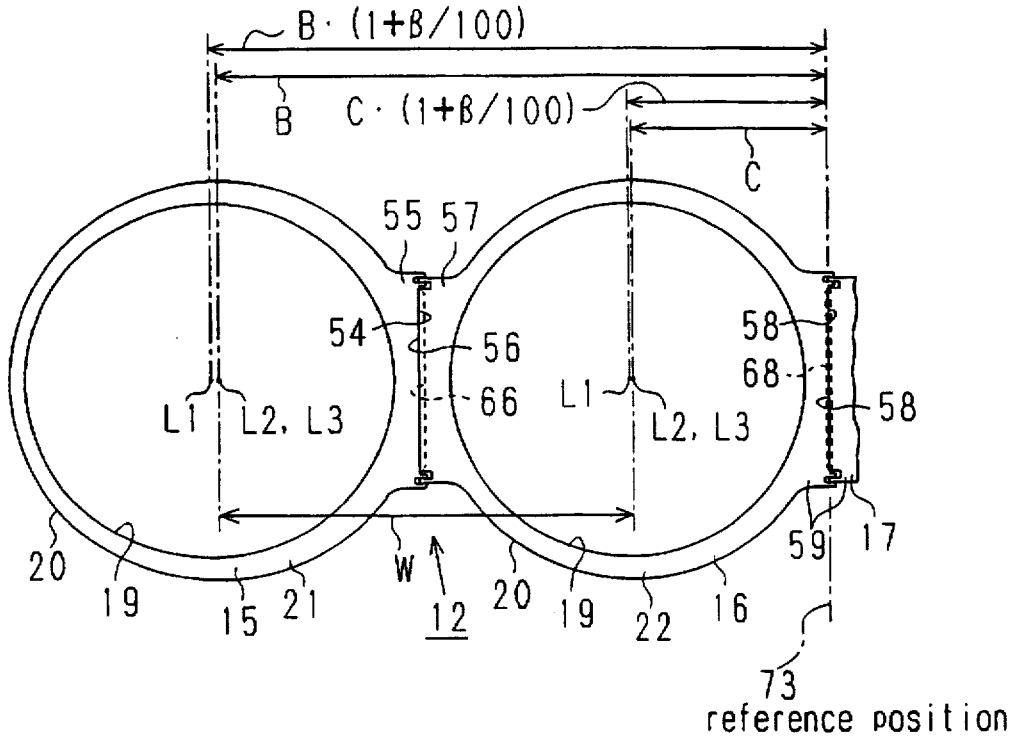
FIG. 20 is a partial plan view showing a liner assembly according to a third embodiment of the present invention.

As shown in FIG. 20, the cylinder liners 15–18, which constitute the liner assembly 12, have connecting section s 57, 59 formed integrally with their outer cylindrical surface 20. The axis L2 of each outer cylindrical surface 20 is offset from the axis L1 of the associated inner cylindrical surface 19 in a direction toward the middle of the liner assembly 12. In other words, the wall thickness of each cylinder 21–24 varies. The walls of each cylinder 21–24 become thicker on the side facing the center of the liner assembly 12.

More specifically, the axis L2 of the outer cylindrical surface 20 of the cylinder 21 included in the first cylinder liner 15 coincides with the axis L3 of the cylinder bore #1. The axis L2 of the outer cylindrical surface 20 of the cylinder 22 included in the second cylinder liner 16 coincides with the axis L3 of the cylinder bore #2.

The abutting section between the second and third cylinder liners 16, 17 serve as a reference position 73. The distance between the reference position 73 and the axis L3 of the cylinder bore #1 (or #4) is represented by B. The distance between the reference position 73 and the axis L3 of the cylinder bore #2 (or #3) is represented by C. The alteration rate of the distance W between adjacent axes L2 when the molten metal Contracts as it solidifies is represented by β. The axis L1 of the inner cylindrical surface 19 in the first cylinder liner 15 (or the fourth cylinder liner 8) is separated from the reference position 73 by a distance expressed by B·(1+β/100). The axis L1 of the inner cylindrical surface 19 in the second cylinder liner 16 (or the third cylinder liner 17) is separated from the reference position 73 by a distance expressed by C·(1+β/100). In other words, the contraction of the molten metal is taken into consideration when offsetting the axis L1 away from the associated axis L3. The offset position corresponds to the axis Lx of the associated insertion pin 45 in the mold 36.

Figure 22:
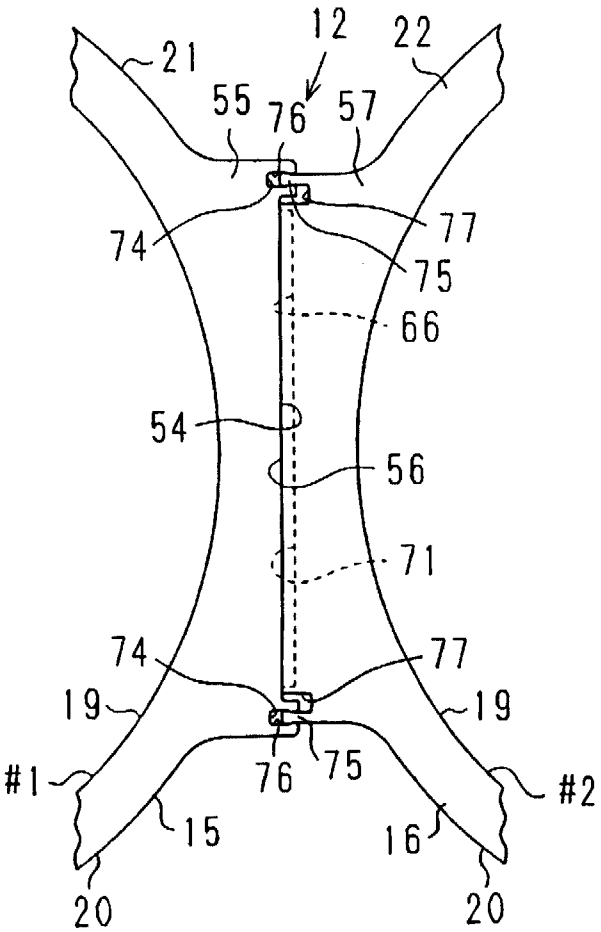
FIG. 22 is a plan view showing a connecting section adjacent cylinder liners.

In this embodiment, the following structure is employed to connect adjacent cylinder liners 15–18. As shown in FIG. 22, a groove 74 is defined on each side of either one of the abutting surfaces 54, 56 (or 58, 58). Each groove 74 extends parallel to the axis L1. A projection 75 corresponding to each groove 74 and extending parallel o the axis L1 is provided on the other abutting surface. The projections 75 engage the associated groove 74. The engaged grooves 74 and projections 75 correspond to the position where the holes 67, 69 are formed in step (F).

The grooves 74 and the associated projections 75 are engaged in a manner such that they allow molten metal to enter spaces 76, 77 that are defined therebetween. It is required that each space 96, 77 have a width of 0.2 mm or more to allow molten metal to be drawn therein. There is a possibility that a sufficient amount of molten metal (in this case, aluminum) will not enter the spaces 76, 77 if their width is more narrow than 0.2 mm.

Each step of the method to manufacture the cylinder block 11 of this embodiment will now be described. In the same manner as the second embodiment, the method consists of steps (A)–(F).

Cylinder Liner Formation Step (A)

In the same manner as the first embodiment, in step (A), billets are produced through the CIP method. The billets are then extruded to produce an elongated product having double-layer structure. By cutting the elongated product into predetermined lengths, cylinder liner s having a cylinder and a single connecting section are obtained. Cylinder liners having a cylinder and two connecting sections are also obtained by cutting the elongated product in the same manner. The axis of the outer cylindrical surface is offset from the axis of the inner cylindrical surface in each cylinder. Thus, the wall of each cylinder becomes thicker on the side facing the center of the group of cylinders.

Liner Assembly Formation Step (B)

In step (B), the cylinder liners 15–18 are connected to one another so as to align the cylinders 2–24 in a single row. More specifically, the adjacent cylinder liners 15–18 are moved toward each other so as to engage the groove 74 with the associated projection 75. The engagement enables the abutting surfaces 54, 56 (or 58, 58) to abut against each other. The connected cylinder liners 15–18 define a liner assembly 12 having spaces 66 (or 68) and spaces 76, 77 defined between the connecting sections 55, 57 (or 59, 59).

Liner Assembly Positioning step (c)

In step (C), the movable molds 38–40 are separated from the molding projections 43 in the same manner as the first embodiment. The liner assembly 12 is inserted into the space 43*a* defined between the corresponding projection 43 and pin 46. This fits the liner assembly 12 on the pins 45 and positions the assembly 12 in the mold 36 (refer to FIG. 5). In this state, the axis 19 of each inner cylindrical surface 19 is offset with respect to the axis L3 of the associated cylinder bore #1–#4 to a position corresponding to the axis Lx of the associated insertion pin 45. This enables the cylinder liners 15–18 to be fitted on the corresponding pin 45.

Block Body Formation Step (D)

In step (D), the movable molds 38–40 are moved toward the projections 43 to define the cavity 47 between the fixed mold 37, the movable molds 38–40, and the liner assembly 12, Molten metal is charged into the cavity 47 through the passage 48 defined in the lateral movable mold 40 (refer to FIG. 7). The width of each space 76, 77 (0.2 mm or greater) is wide enough to securely enable the molten metal to flow therein when filling the cavity 47 with the metal.

The molten metal charged in the cavity 47 contracts 0.6% as it solidifies and produces stress that is applied to the cylinder liners 15–18. However, the length of the liner assembly 12 remains unchanged.

When the molten metal is solidified, a rough block material 49 is obtained with the liner assembly 12 insert molded in aluminum. The block material 49 includes the spaces 76, 77 that are filled with aluminum and the water jacket 35 that is defined about the assembly 12.

As shown in FIG. 8, the movable molds 38–40 are than moved away from the molding projections 43. The block material 49 is than pushed out of the mold 36 by pushing pins (no shown).

In the block material 49, the inner cylindrical surface 19 of each cylinder 21–24 of the liner assembly 12 is exposed. The other parts of the liner assembly 12 is encompassed by the aluminum casting (block body 34). The closed spaces 66 (or 68) are defined between each of the adjacent connecting sections 55, 57(or 59, 59). In this state, the closed spaces 66, 68 are not yet connected with the water jacket 35.

Cylinder Bore Formation Step (E)

In step (E), the inner cylindrical surface 19 in the cylinder 21 of the first cylinder liner 15 is machined about a point that is separated by a predetermined distance B from the reference position 73. The inner cylindrical surface 19 in the cylinder 22 of the second cylinder liner 16 is machined about a point that is separated by a predetermined distance C from the reference position 73. The axis L2 of the outer cylindrical surface 20 of each cylinder 21–24 is offset toward the reference position 73 with respect to the axis L1 of the associated inner cylindrical surface 19. In addition, each inner cylindrical surface 19 is machined about the axis L3, which is separated from its own axis L1. This allows the wall thickness of each machined cylinder 21–24 to be uniform. Thus, as in the first embodiment, the produced cylinder block 11 has a structure that does not include weaker sections.

Hole Formation Step (F)

Figure 21:
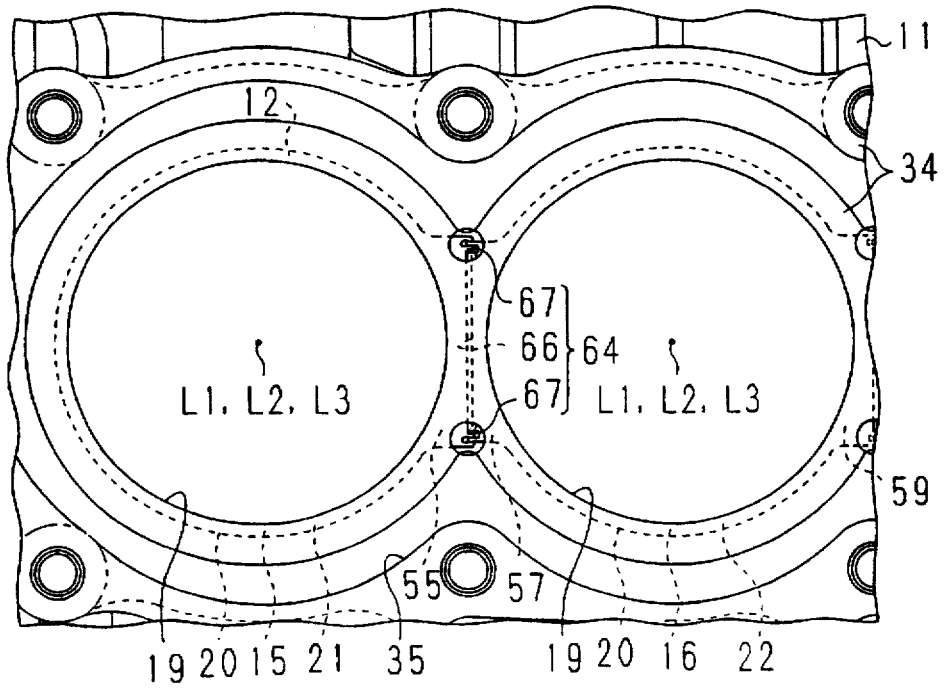
FIG. 21 is a partial plan view showing a cylinder block.
Figure 23:
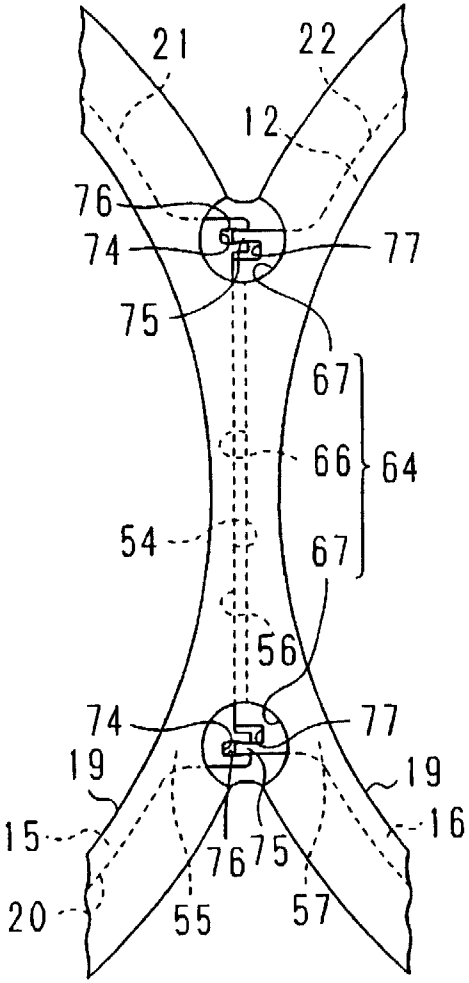
FIG. 23 is a plan view showing the connecting section of adjacent cylinder liners.
Figure 24:
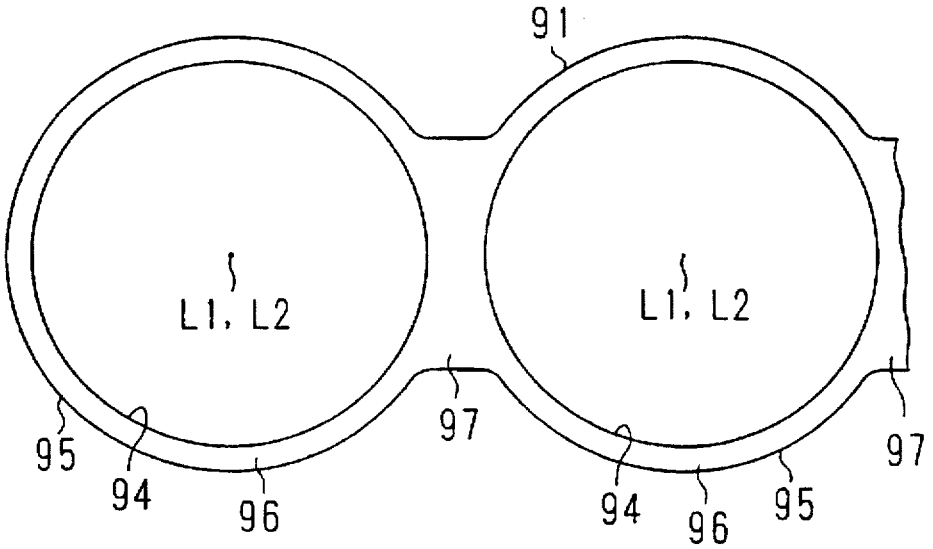
Fig.24(Prior Art)
FIG. 24 is a partial plan view showing a prior art cylinder liner.
Figure 25:
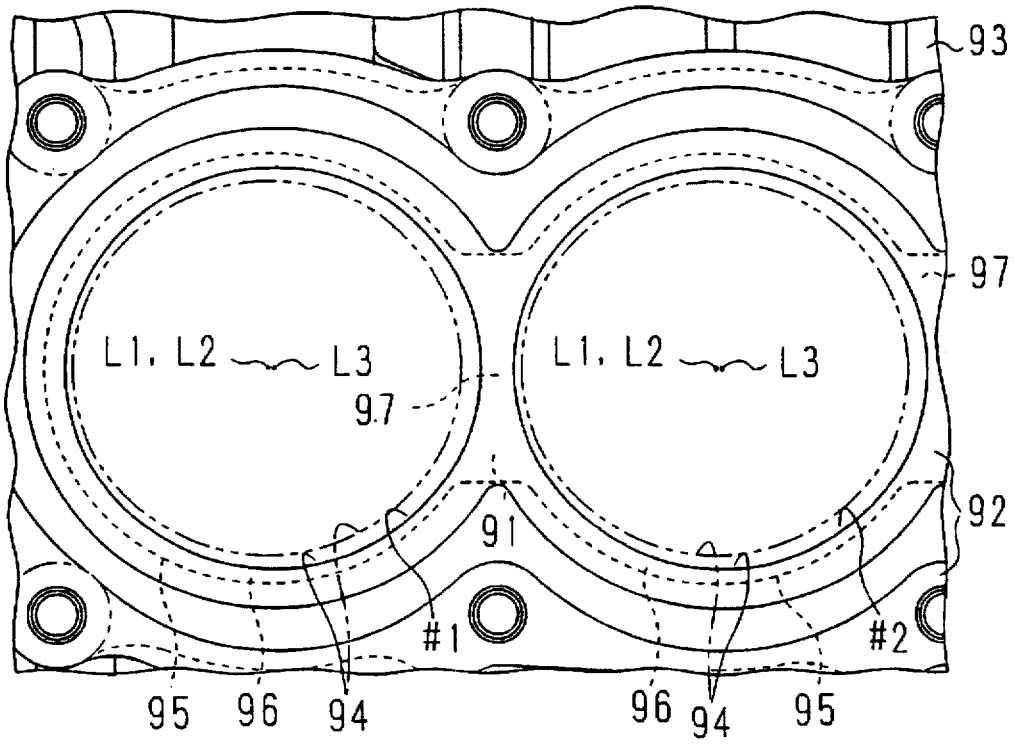
Fig.25(Prior Art)
FIG. 25 is a partial plan view showing a cylinder block manufactured through a method in the prior art.

In the same manner as the second embodiment, as shown in FIGS. 21 and 23, in step (F), the sides of the abutted part of the connecting sections 55, 57 (or the connecting sections 59, 59) are perforated by drills, or the like, to define the holes 67, 69. The holes 67, 69 connect the ends of each closed space 66, 68 with the water jacket 35. The closed spaces 66, 68 and the holes 67, 69 constitute a coolant passage 64, 65 between the bores #1–#4.

In this embodiment, the spaces 76, 77 are filled with metal. This prevents the coolant 63 from entering each space 76, 77 when flowing through the holes 67, 69. Thus, the coolant 63 does not leak out of the bottom of the cylinder block 11 through each space 76, 77 into a crankcase 79.

Although only three embodiments of the present invention have been described herein, it should be apparent to those skilled in the art that the present invention may be embodied in many other specific forms without departing from the spirit or scope of the invention. Particularly, it should be understood that the present invention may be embodied as described below.

In the first embodiment, the adhesive layer 29 is provided between each pair of adjacent cylinder liners 15–18 when forming the liner assembly 12 in step (B). However, the adhesive layers 29 may be omitted from the liner assembly 12. This may cause the molten metal to enter the spaces 31–33 when forming the block body 34 in step (D). In such case, the flexibility of the molten metal allows each space 31–33 to be narrowed. Thus, the relative movement of the cylinder liners 15–18 is not completely blocked by the molten metal.

The serrations 61 employed in the second embodiment may also be provided on the outer cylindrical surface 20 of each cylinder 21–24 in the first and third embodiments.

Methods such as die casting, medium pressure casting, low pressure casting, gravity casting, suction casting, or the like may be employed to produce the block body 34.

In addition to silicone adhesives, ceramic or alumina adhesives may also be used as the material of the adhesive layers 29, 62.

In addition to aluminum alloy, cast iron or alloyed cast iron may be used as the material of the cylinder liners 15–18. In this case, the cylinder liners 15–18 are formed through casting. The projections 25, 27, 75 and the grooves 71, 72, 74 may be formed roughly when casted and finished through machining, The manufacturing method of the present invention is not limited to cylinder blocks having four cylinders but may be applied to cylinder blocks having two cylinders or more.

In the third embodiment, each pair of adjacent cylinder liners 15–18 may be connected to each other by welding together their peripheral sections. Each pair of adjacent cylinder liners 15–18 may also be connected to each other by engaging keyways provided in the sides of one of the abutting surface with corresponding keys provided on the opposed abutting surface.

Therefore, the present examples and embodiments are to be considered is illustrative and not restrictive and the invention is not to be limited to the details given herein, but may be modified within the scope of the appended claims.

What is claimed is:

1. A method for manufacturing a cylinder block for an internal combustion engine, wherein said cylinder block has a liner assembly and a block body molded around the liner assembly, said liner assembly having a plurality of adjacent cylinder liners, wherein each cylinder liner has an outer cylindrical surface, an inner cylindrical surface and a cylinder bore formed in the inner cylindrical surface, each outer cylindrical surface, inner cylindrical surface and cylinder bore having an independent axis, wherein each cylinder bore axis is set at a predetermined position in the cylinder block, said method comprising:

forming said cylinder liners such that the outer cylindrical surface and the inner cylindrical surface of the same cylinder liner are coaxial and such that each liner includes a variable coupling structure on its outer surface;

forming said liner assembly by coupling said cylinder liner with each other using the variable coupling structure to align the cylinder liners in a single row, wherein the step of forming the liner assembly includes mating the coupling structure of one liner with that of an adjacent liner to allow variation of the distance between the axes of the outer cylindrical surfaces of adjacent cylinder liners;

positioning said liner assembly in a mold such that the axis of the outer cylindrical surface of each liner is offset from the predetermined position of the axis of the cylinder bore associated therewith;

molding said block body around the liner assembly by pouring molten metal into a mold and by solidifying the molten metal, wherein the axis of the outer cylindrical surface of each liner relocates to substantially coincide with the predetermined position o the axis of the associated cylinder bore as a consequence of movement of the variable coupling structures as the molten metal cools and is solidified; and forming each cylinder bore at the predetermined positions by machining each inner cylindrical surface, wherein the predetermined position of each cylinder bore axis is a predetermined distance from a predetermined reference position on the block body.

2. The method according to claim 1, wherein each variable coupling structure projects radially outward from the outer cylindrical surface of the associated liner and has an engaging surface defined thereon, and wherein each variable coupling structure extends in a direction parallel to the axis of the associated outer cylindrical surface; and wherein said step of forming the liner assembly includes providing a flexible adhesive layer between the mated coupling structures.

3. The method according to claim 1, wherein at least one variable coupling structure of each cylinder liner has at least one recess that forms at least one closed space located between the cylinder liners when the variable coupling sections are mated;

wherein said step of molding the block body includes forming a water jacket around the liner assembly; and wherein said method further includes a step of forming a communicating passage that communicates said closed space to said water jacket to form a cooling passage.

4. The method according to claim 1, wherein said mold includes a fixed mold part and a plurality of movable mold parts, and wherein said step of positioning the liner assembly includes pressing the liner assembly against the fixed mold part by one of the movable mold parts when said mold is closed.

5. A method for manufacturing a cylinder block for an internal combustion engine, wherein said cylinder block has a liner assembly and a block body molded around the liner assembly, said liner assembly having a plurality of adjacent cylinder liners, wherein each cylinder liner has an outer cylindrical surface, an inner cylindrical surface and a cylinder bore formed in the inner cylindrical surface, each said outer cylindrical surface, inner cylindrical surface and cylinder bore having an independent axis, wherein said cylinder bore axis is set at a predetermined position in the cylinder block, said method comprising:

forming said cylinder liners, wherein the axis of each outer cylindrical surface is offset from the axis of the inner cylindrical surface of same cylinder liner, and wherein the outer cylindrical surfaces of the cylinder liners have same diameter;

forming said liner assembly by connecting said cylinder liners with each other to align the cylinder liners in a single row;

positioning said liner assembly in a mold such that the axis of the outer cylindrical surface of each liner coincides with the predetermined position of the associated cylinder bore axis;

molding said block body around the liner assembly by pouring molten metal into the mold and by solidifying the molten metal; and forming each cylinder bore by machining said inner cylindrical surface of each cylinder liner about the axis of each cylinder bore such that the axis of the inner cylindrical surface substantially coincides with the axis of the cylinder bore when the cylinder bore is machined.

6. The method according to claim 5, wherein each cylinder liner includes a coupling structure on the outer cylindrical surface thereof, each coupling structure being adapted to engage with a mating coupling structure of an adjacent cylinder liner to connect the cylinder liners in the step of forming the liner assembly, wherein the coupling structure of each cylinder liner has at least one recess that forms at least one closed space located between the cylinder liners when the coupling structures are mated, wherein said step of molding the block body includes:

forming a water jacket around the liner assembly; and forming a communicating passage that communicates said closed space with the water jacket to form a cooling passage.

7. The method according to claim 6, including the step of:

locating the closed space near a part of the cylinder block that is heated to a high temperature relative to other parts of the cylinder block when the engine is operated.

8. The method according to claim 6, wherein each cylinder liner has a plurality of fittings provided in its coupling structure, each fitting engaging with an associated fitting of an adjacent one of the cylinder liners to form a gap in the vicinity of each fitting or allowing molten metal to enter therein, and wherein said method further includes the step of:

filling said gaps with molten metal between the step of forming said liner assembly and the step of forming the communicating passage.

9. The method according to claim 6, wherein said mold includes a fixed mold part and a plurality of movable mold parts, and wherein said step of positioning said liner assembly includes pressing said liner assembly against said fixed mold part with one of said movable mold parts when said mold is closed.

10. A liner assembly for use in a molten metal molding process of a molded cylinder block, wherein the block has a plurality of cylinder bores, the axes of which are respectively located at predetermined distances from a fixed location on the cylinder block, said assembly comprising:

a plurality of adjacent cylinder liners, wherein each cylinder liner has an outer cylindrical surface and an inner cylindrical surface adapted to have one of the cylinder bores formed therein, each outer cylindrical surface, inner cylindrical surface and cylinder bore having an independent axis;

a variable coupling means formed between adjacent liners of the assembly for coupling said cylinder liner with each other to align the cylinder liners in a single row such that one liner mates with an adjacent liner to allow for a change of the distance between the axes of the outer cylindrical surfaces of adjacent mated cylinder liners during the molding process, wherein the axis of the outer cylindrical surface of each liner is located at a position that is offset by a predetermined distance from the predetermined position of the axis of the cylinder bore associated therewith that the axis of the outer cylindrical surface of each liner move the predetermined distance to substantially coincide with the predetermined position of the axis of the associated cylinder bore as a consequence of movement of the liners as the molten metal cools and is solidified, wherein at least a part of the variable coupling means is a structure that projects outwardly from the outer cylindrical surface of each liner and extends longitudinally in a direction parallel to the a xi of the outer cylindrical surface thereof.

11. The assembly according to claim 10, wherein each cylinder liner includes a projection and a mating receptacle On the outer cylindrical surface thereof and wherein the projection and the receptacle extend parallel to the axis of the outer cylindrical surface, and wherein each variable coupling means is formed by engagement of one of the projections with an associated receptacle of an adjacent cylinder liner; and wherein a space is formed between each mated receptacle and projection such that the space allows relative movement between each pair of adjacent cylinder liners to alter the distance between the axes of the outer cylindrical surfaces of adjacent cylinder liners.

12. The assembly of claim 11, wherein each space is provided with an adhesive.

13. The assembly of claim 12, wherein said adhesive is a silicone-based adhesive.

14. The assembly of claim 11, wherein each projection has a pair of distal ends, and wherein each receptacle has a pair of walls adapted to engage with the distal ends of the projection.

15. The assembly of claim 11, wherein each projection includes a pair of fingers extending parallel to the axis of the outer cylindrical surface, wherein said fingers are adapted to engage with a receptacle along a line of contact.

16. The assembly of claim 10, wherein the variable coupling means includes a flexible adhesive layer provided between the outwardly projecting structures of adjacent liners, and wherein the adhesive layer allows relative movement between the axes of the outer cylindrical surfaces of adjacent cylinder liners.

17. The assembly of claim 16, wherein said adhesive layer has a region with a greater area than other regions of the same layer at a position that is closest to a location where molten metal is introduced during the molding process.

18. The assembly according to claim 10, wherein said cylinder block is employed in an internal combustion engine, and wherein said space is located near a part of the cylinder block that is heated to a high temperature relative to other parts of the cylinder block when the engine is operated.

19. A liner assembly for use in molten metal molding process of a molded cylinder block for an internal combustion engine, wherein the block has a plurality of cylinder bores, the axes of which are respectively located at predetermined distances from a fixed location on the cylinder block, said assembly comprising:

a plurality of adjacent cylinder liners, wherein each cylinder liner has an outer cylindrical surface and an inner cylindrical surface adapted no have one of the cylinder bores formed therein, each outer cylindrical surface, inner cylindrical surface and cylinder bore having an independent axis, the liners being formed such that the axis of each outer cylindrical surface is offset from the axis of the inner cylindrical surface of same cylinder liner, and such that the outer cylindrical surfaces of the cylinder liners have the same diameter;

said cylinder liner being connected with each other to align the cylinder liners in a single row such that the assembly is adapted to be positioned in a mold such that the axis of the outer cylindrical surface of each liner coincides with the predetermined position of the associated cylinder bore axis, and such that the cylinder block can be molded around the liner assembly by pouring molten metal into a mold and by solidifying the molten metal; and each cylinder bore is machined in said inner cylindrical surface of each cylinder liner about the axis of each cylinder bore such that the axis of each inner cylindrical surface substantially coincides with the axis of the associated cylinder bore.

20. The assembly of claim 19, wherein each cylinder liner includes a coupling structure on the outer cylindrical surface thereof, each coupling structure being adapted to engage with a mating coupling structure of an adjacent cylinder liner to connect the cylinder liners, wherein the coupling structure of each cylinder liner has at least one recess that forms at least one closed space located between the cylinder liners when the coupling structures are mated.

21. The assembly of claim 20, wherein the closed space is located near a part of the cylinder block that is heated to a high temperature relative to other parts of the cylinder block when the engine is operated.

22. The assembly of claim 19, wherein each cylinder liner has a plurality of fittings provided on the outer cylindrical surface thereof, each fitting engaging with an associated fitting of an adjacent one of the cylinder liners to form a gap in the vicinity of each fitting for allowing molten metal to enter therein.

23. The assembly of claim 22, wherein said gap extends longitudinally along the cylinder liner and has a minimum width of greater than 0.2 mm.

* * * * *